US006024358A

United States Patent [19]

Steinberg

[11] Patent Number: 6,024,358

[45] Date of Patent: Feb. 15, 2000

[54] DEVICE FOR THE SEPARATION OF STACKED FLAT OBJECTS

[75] Inventor: Jürgen Steinberg, Hörstel, Germany

[73] Assignee: Windmoller & Holscher, Lengerich/Westf., Germany

[21] Appl. No.: 09/320,652

[22] Filed: May 27, 1999

[30] Foreign Application Priority Data

May 27, 1998 [DE] Germany ..... 198 23 752
Jul. 10, 1998 [DE] Germany ..... 198 30 982

[51] Int. Cl.[7] ..... B65H 3/050

[52] U.S. Cl. ..... 271/101; 414/797.8

[58] Field of Search ..... 271/99, 100, 101; 414/797.6, 797.7, 797.8

[56] References Cited

U.S. PATENT DOCUMENTS 5,106,070 4/1992 Reist ..... 271/101 X

FOREIGN PATENT DOCUMENTS 337553 5/1959 Switzerland ..... 414/797.8
637087 7/1983 Switzerland .

*Primary Examiner*—Janice L. Krizek
*Attorney, Agent, or Firm*—Jacobson, Price, Holman & Stern PLLC

[57] ABSTRACT

The invention relates to a device for the separation of stacked objects, the device comprising a stack bearing area, which is formed by a grid of rollers, travelling along the bottom area of the stack, whereby the rollers of the grid of rollers are positioned at an angle relative to the roller grid's direction of motion, and the device comprising a suction element and a conveyor, which reaches under the stack surface, in order to take away the flat objects separated from the stack. The invention provides an arrangment that automatically sets the rollers of the grid of rollers into self-rotation.

7 Claims, 2 Drawing Sheets

DEVICE FOR THE SEPARATION OF STACKED FLAT OBJECTS

Figure 1:
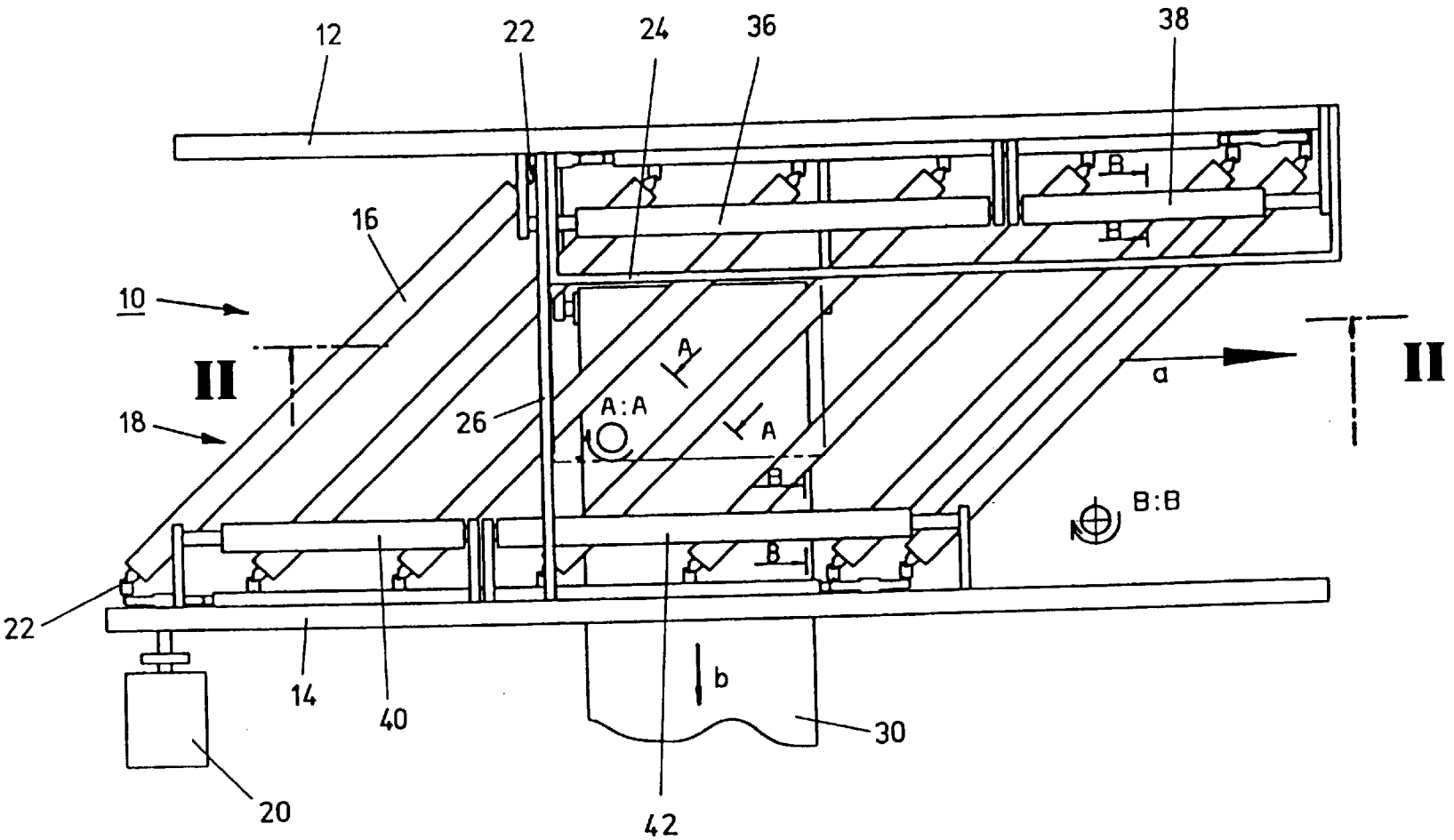

The invention relates to a device for the separation of stacked flat objects, in particular the separation of stacked tubular segments, which are to be processed into sacks, according to the preamble of claim 1.

The DE 195 39 935 A1 of the same applicant discloses a device for the separation of stacked flat objects. Said device comprises in essence a stack hopper, whose bottom, which supports the stack, is formed by passing rollers, which roll away at the bottommost workpiece and belong to a travelling grid of rollers. In the case of this solution a conveyor system, which runs at an angle to the carrying run of the grid of rollers, is arranged below said carrying run. The bottommost workpiece, which is peeled from the stack by a passing roller, is tossed on the conveyor system. In time with the passage of the rollers a row of suction elements reaches between these rollers and pulls off in such a manner a side edge of the bottommost workpiece between two rollers that the leading roller still supports the stack above the workpiece; and the following roller passes between the workpiece and the workpiece located above it. The result is a reliable separation of the bottommost workpiece from the stack. This prior art system provides a row of suction elements, which runs parallel to the grid of rollers. This row of suction elements is large and necessitates that large masses have to be moved during the operation of the separating device.

The CH 637 087 A5 discloses a device, where the separating device comprises only one single suction element for the purpose of pulling down the edge of the bottommost flat object. This design is possible because the rollers of the grid of rollers are at an oblique angle relative to the roller grid's direction of motion so that when said object is grasped, i.e. the comer region of the flat object is sucked in, said object can be reliably separated from the remaining stack merely by positioning the rollers at an angle. Of course, in this prior art device the stack, carried by the grid of rollers, is stressed in the direction of motion and vertically thereto with a component of motion due to the oblique position of the roller grid's rollers so that it tends to move out of its original deposited position, in which it can be reliably grasped by the suction tool and moved into a displaced position, where the suction element can no longer grasp the appropriate corner of the bottommost flat object of the stack.

Therefore, the object of the invention is to improve a device of the aforementioned class in such a manner that the stack of flat objects that are to be separated does not leave its deposited position in the drive chain's direction of motion despite the oblique position of the grid of rollers.

This problem is solved largely by a device according to the preamble of claim I through combination with the features of the characterizing part of claim 1. The invention provides here means that automatically set the rollers of the grid of rollers into self rotation. The invention is based on the knowledge that the rollers of the driven grid of rollers will exert an undesired component of motion on the deposited stack of flat objects, if the rollers are in quiescent position when they grasp the stack.

If, on the other hand, the rollers are set into suitable self-rotation by means of appropriate means at the instant they grasp the stack, they do not exert any significant component of motion on the stack that moves said stack out of its deposited position.

One special advantage lies in the fact that the rollers of the grid of rollers can be set into rotation by means of suitable rolls, which are mounted so as to rotate freely and exhibit elastic surface and whose axes of rotation are oriented longitudinally to the roller grid's direction of motion and on whose surfaces the rollers of the grid of rollers can roll off. The rotational speed of the rollers of the grid of rollers can be set by selecting the diameter ratio between the rolls and the rollers of the grid of rollers that roll over them.

Preferred embodiments of the invention results from the other dependent claims, following claim 1.

Other details and advantages of the invention are explained in detail with reference to the embodiment, depicted in the drawings.

Figure 2:
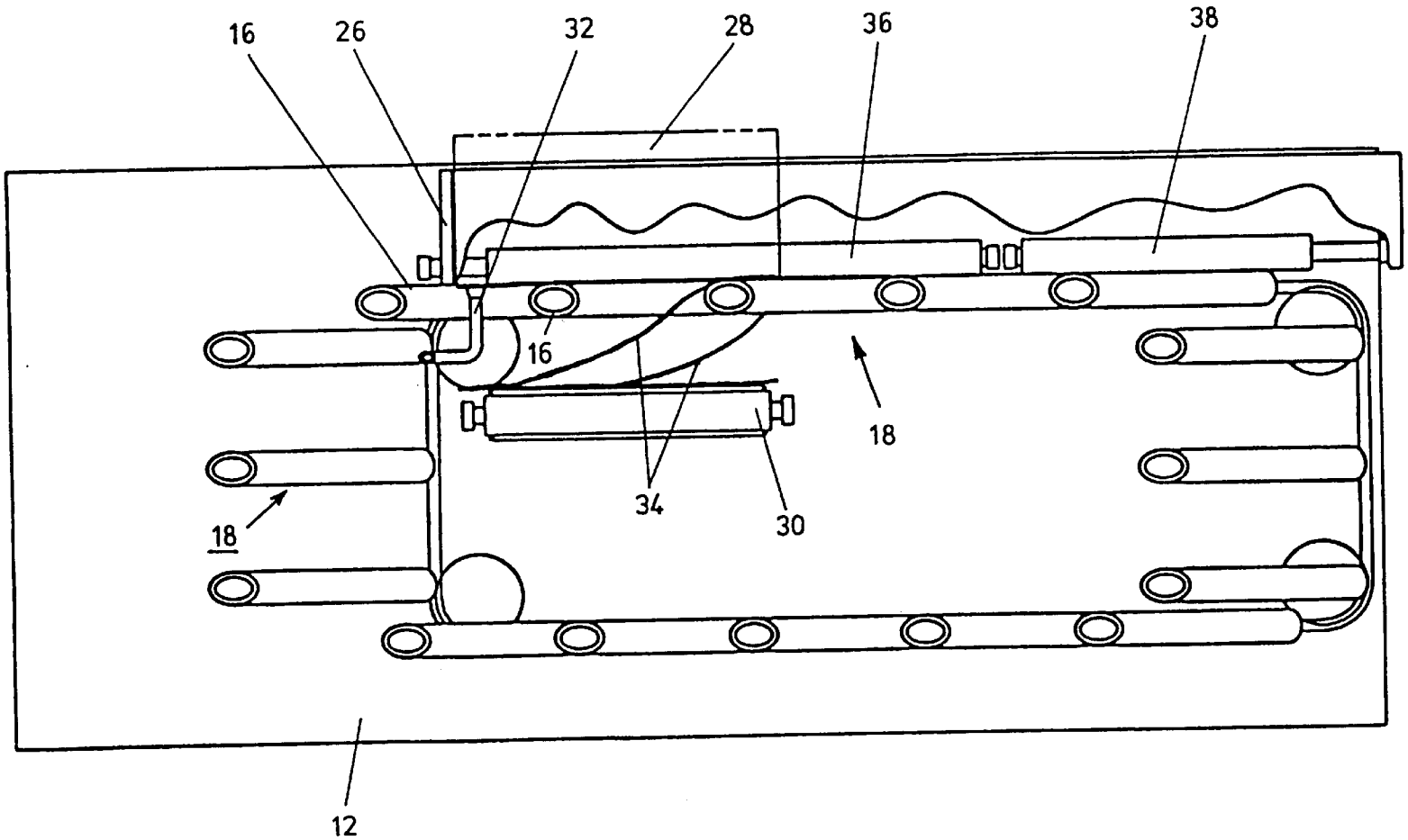

FIG. 1 is a top view of a device for the separation of stacked flat objects, according to one embodiment of the present invention, and FIG. 2 is a sectional view along the line II—II FIG. 1.

The separating device 10 comprises a machine frame with the side members 12 and 14, where a grid of rollers 18, comprising rollers 16, is guided sideways by means of revolving chains, whereby at least one side chain of the grid of rollers 18 can be driven by means of a transversely flanged motor 20 in the direction a of the arrow. The rollers of the grid of rollers 118 are positioned at an angle to the direction of motion a, as shown in FIG. 1. The oblique rollers 16 of the grid of rollers can rotate freely in bearings 22. In FIG. 1 a transverse stop bar 24 and a rear stop bar 26, which are oriented parallel or vertically to the side members 12 and 14 of the machine frame 10, are arranged above the plane, formed by the grid of rollers 18. FIG. 2 shows how a stack of deposited tubular segments 28 rests against the rear stop bar 26.

A conveyor 30 is arranged below the tubes 28, deposited in the stack, and the grid of rollers 18 that carry said stack for the purpose of carrying away the flat objects separated from the stack. In the present example this conveyor comprises a conveyor belt, which is moved in the direction of the arrow b according to FIG. 1.

FIG. 2 shows a suction element 32, which grasps between the rollers in time with the passage of the rollers 16 and which grasps the bottommost flat object, for example the corresponding tube, of the deposited stack 28 and pulls it down to such an extent between two successive rollers 16 of the roller grid 18 that the corresponding flat object 34 is peeled from the stack by means of the passing roller 16 and deposited on the conveyor belt 30.

Rolls 36, 38 or 40 and 42 are arranged parallel to the side members 12 and 14. These rolls are arranged in such a manner that the ends of the rollers 16 of the grid of rollers that lie close to the side members 12 or 14 can roll on them. The rolls 36, 38, 40 and 42 can rotate so that, when the rollers 16 roll on the corresponding rolls 36, 38, 40 and 42, the result is the directions of rotation of the rollers 16 or rolls 36, 38, 40 and 42 in accordance with the views A—A and B—B in FIG. 1. Thus the rollers 16 are already set in self-rotation at the instant at which they make contact with the deposited stack of flat objects 28. Thus only a component of motion in the direction of the stop bar 24 is exerted on the deposited stack, thus resulting in the entire stack being gently laid against the stop bar. Thus the stack 28 remains in its position so that the suction element 32 can always grasp the comer region of the bottommost flat object.

The rolls 36 and 38 or 40 and 42 are designed as two parts, since with only one rubber roll travelling over the entire length of the rolls 36 and 38 there would be the risk that said rubber roll would bend and thus no longer make sealing contact with the passing rollers 16. The rolls 36 or 38 and 40 or 42 are offset so as to match the oblique position of the rollers 16 of the grid of rollers 18. As shown in FIG. 1, the rolls 40 or 38 are shorter than the rolls 36 and 42. The rollers 16 make contact, as shown in FIG. 1, with the shorter rubber roll 40 first on the side of the side member 14, whereas they make contact just about simultaneously with the longer rubber roll 36 at the side member 12. During the passage of the grid of rollers in the direction of motion a, the rollers 16 are already leaving the shorter rubber roll 40, while their opposite end is still making contact with the longer rubber roll 36, which drives the rollers on until they touch the longer rubber roll 42, mounted on the side member 14 and roll along it so that they are again driven here. During the transition from the longer rubber roll 36 at the side member 12 to the shorter rubber roll 38 at the side member 12, the rollers 16 are still connected to the longer rubber roll 42 at the side member 14 so that here, too, during transition, it is guaranteed that the rollers 16 will be set into rotational motion and will not stop during transition.

The speed of the self-rotation of the rollers 16 can be set by selecting the diameter ratio of the rolls 36, 38, 40 or 42 to the roller diameter 16.

I claim:

1. Device for the separation of stacked flat objects, in particular for the separation of stacked tubular segments, which are to be processed into sacks, said device comprising a stack bearing area, which is formed by a grid of rollers, travelling along the bottom area of the stack, whereby the rollers of the grid of rollers are positioned at an angle relative to the roller grid's direction of motion, and said device comprising a suction element and a conveyor, which reaches under the stack surface, in order to take away the flat objects separated from the stack, characterized in that there are means that automatically set the rollers of the grid of rollers into self-rotation.

2. Device, as claimed in claim 1, characterized in that the means consist of rolls, which are mounted so as to rotate freely and whose axes of rotation are oriented parallel relative to the roller grid's direction of motion and on whose surface the rollers of the grid of rollers can roll off during the roller grid's motion.

3. Device, as claimed in claim 1, characterized in that the rolls have an elastic surface.

4. Device, as claimed in claim 2, characterized in that the rolls are arranged in the lateral regions of the grid of rollers.

5. Device, as claimed in claim 2, characterized in that the rolls are divided over their length.

6. Device, as claimed in claim 4, characterized in that the rolls are divided into a longer and a shorter rubber roll; and that the rolls, arranged in the side region of the grid are offset with respect to each other in accordance with the oblique position of the rollers of the grid of rollers.

7. Device, as claimed in claim 4, characterized in that on a first side of the grid a shorter rubber roll makes contact with the leading roller of the grid of rollers in the roller grid's direction of travel, while on the opposite second side a longer rubber roll makes contact with the corresponding roller, whereby, as the grid continues to travel, a longer rubber roll on the first side then makes contact with the roller, while the roller on the second side is still set into rotation by the longer rubber roll and characterized in that subsequently while said roller is still set into rotation by the longer rubber roll on the first side, the roller on the second side can make contact with a shorter rubber roll.

* * * * *